US005970876A

United States Patent [19]

Haglund

[11] Patent Number: 5,970,876

[45] Date of Patent: Oct. 26, 1999

[54] IGNITION DEVICE

[75] Inventor: Nils Haglund, Torshälla, Sweden

[73] Assignee: BOFORS AB, Karlskoga, Sweden

[21] Appl. No.: 08/945,711

[22] PCT Filed: Apr. 26, 1996

[86] PCT No.: PCT/SE96/00551

§ 371 Date: Jan. 30, 1998

§ 102(e) Date: Jan. 30, 1998

[87] PCT Pub. No.: WO96/35096

PCT Pub. Date: Nov. 7, 1996

[30] Foreign Application Priority Data

May 2, 1995 [SE] Sweden ..... 9501603

[51] Int. Cl.[6] ..... F42C 19/07

[52] U.S. Cl. ..... 102/216; 102/293

[58] Field of Search ..... 102/216, 293

[56] References Cited

U.S. PATENT DOCUMENTS

| | | | |
|---|---|---|---|
| 3,188,960 | 6/1965 | Samburoff | 102/216 |
| 3,667,393 | 6/1972 | Aronsson et al. | 102/210 |
| 3,769,911 | 11/1973 | Folkins | 102/102 |
| 3,788,225 | 1/1974 | Held | 102/499 |
| 3,894,490 | 7/1975 | Zacharin | 102/216 |
| 4,176,608 | 12/1979 | Ambrosini et al. | 102/216 |
| 4,480,550 | 11/1984 | Abt | 102/215 |
| 4,587,903 | 5/1986 | Bertram et al. | 102/216 |
| 4,620,483 | 11/1986 | Simpson | 102/222 |
| 4,793,256 | 12/1988 | Webb | 102/210 |
| 5,157,221 | 10/1992 | Ronn | 102/216 |
| 5,180,882 | 1/1993 | Bansard | 102/216 |
| 5,520,115 | 5/1996 | Braun | 102/215 |
| 5,539,410 | 7/1996 | Zvelgvich | 342/68 |

FOREIGN PATENT DOCUMENTS

| | | | |
|---|---|---|---|
| 0 196 283 A1 | 10/1986 | European Pat. Off. . | |
| 0 285 212 A2 | 10/1988 | European Pat. Off. . | |
| 0 433 254 A1 | 6/1991 | European Pat. Off. . | |
| 1292321 | 3/1962 | France | 102/216 |
| 2 294 426 A1 | 7/1976 | France . | |
| 2300324 | 10/1976 | France | 102/216 |
| 3315406 | 6/1984 | Germany | 102/216 |

*Primary Examiner*—Charles T. Jordan
*Assistant Examiner*—Christopher K. Montgomery
*Attorney, Agent, or Firm*—Pollock, Vande Sande & Amernick

[57] ABSTRACT

An ignition system for an ammunition-bearing unit includes at least two casings, an inner and an outer casing, which are arranged to at least partially surround each other and are intended to undergo deformation upon striking a target and thus establish electrical contact, and a detecting unit for detecting when electrical contact is established and for, upon actual striking of the target, emitting at least one initiation signal for triggering the charge of the anmunition-bearing unit. At least one of the casings includes plurality of sections which are spaced around its periphery and which are electrically insulated from each other and, upon deformation of the casings establish an individual electrical contact with the opposite at least one part of the at least one other casing. The detecting unit distinguishes at least one electrical contact configuration effected by the sections and, as a function of this at least one configuration resulting from the contact being establish in at least two sections of the casing, generates the initiation signal or the initiation signals.

12 Claims, 2 Drawing Sheets

IGNITION DEVICE

FIELD OF THE INVENTION

The present invention relates to an ignition system arrangement for an ammunition-bearing unit, such as are missiles, shells and the like. The arrangement is of the type in which the ignition system comprises two or more casings arranged at least partially adjacent to one another intended to undergo deformation upon striking the target. Thus establishing electrical contact. The ignition system also comprises a unit which detects that electrical contact is established and which, upon actual striking of the target, emits one or more initiation signals for triggering a charge of the ammunition-bearing unit.

BACKGROUND OF THE INVENTION

It is already known to use twin casings as a sensor for detecting the impact of the shell or the equivalent against targets. To obtain the twin casing, the nose, and if appropriate the sides, of the shell comprise an outer casing whose shape is determined by the requirements of air resistance, etc. In addition, there is an inner casing which often has, although not necessarily, a shape running almost parallel to the outer casing. Both casings are electrically conductive, and electrical contact arises between the casings when they are subjected to deformation. In certain applications, insulation is provided between the casings with the aid of a layer of insulating material which is placed inbetween the casings. For reasons of strength, the inner casing can be produced as an insulating casing with a metal lining. Wires can be run from the twin casing arrangement in a known manner so that the outer envelope of the shell can constitute one of the conductors and an insulated cable which is guided through the warhead to the ignition system constitutes the other conductor. Instead of having the outer envelope of the shell constitute the one conductor, the latter can, in the same way as the second conductor, be formed by an insulated cable.

Other arrangements are also known in connection with twin casing. For example, French Patent 2,294,425 describe how to arrange twin casings of the ammunition unit in an ignition system. The outer casing is separated from the inner casing by material lying between them in accordance with the above. The outer casing transmits mechanical deformation, via the material, to the inner casing which, when the deformation occurs, generates, with the aid of an electrical contact surface on its inner side, an electrical contact with contact members located within the inner casing. The contact members are arranged on electrical conductors (cables) which extend centrally inside the body. The purpose of this known arrangement is to lessen the risk of establishing contact in the event of relatively light impacts, jolts, etc., and under mechanical influences associated with handling, storage and the like.

From the U.S. Pat. No. 3,188,960 it is already known to utilize, in ignition systems, a type of sensor other than the twin casing arrangement described above. In the U.S. Pat. No. 960 the ignition system comprises cylinders which are arranged inside the ammunition-bearing unit and between which extend the rear parts of contact members substantially parallel to each other. The contact members are elongate and their front parts extend beyond the spaces between the cylinders towards the front end of the projectile where they are anchored in an internal, centrally arranged member which is included in the nose part of the projectile. The purpose of this known arrangement is to produce single contact and twin contact functions. This arrangement increases to increase the sensitivity so that initiation can take place in the event of soft targets and at large angles between the longitudinal axis of the projectile or equivalent and a line perpendicular to the target.

SUMMARY OF THE INVENTION

The present invention is to be used in, among other things, anti-tank ammunition and missiles for attacking combat vehicles. The twin casing arrangement is used as circuit breaker in such cases, and when deformation takes place in the twin casing upon the striking of a target, electrical contact arises between outer and inner casing, which will cause the shell or missile to detonate.

In association with the type of combat, the approaching ammunition-bearing unit is exposed to counter-attacking means. The latter can consist, for example, of an arrangement which comprises a sensor system (radar, laser, etc.) which detects approaching ammunition units. The sensor system can in this case be arranged so that approaching objects which are moving at high speed are screened out as objects which cannot be acted against or which cannot be combated. Such screened-out ammunition-bearing units often consist of projectiles which act by kinetic energy. Following the assessment, the sensor system can initiate the firing of splinters, from a suitable launching device, against the detected and approaching shell or equivalent. The splinters can in this case be made just large enough to penetrate or deform the twin casing of the shell. In such cases, there is a high degree of probability that the shell's ignition system will be triggered. The splinters are expediently fired in this way when the shell is located some tens of meters from the tank.

There is therefore a requirement to make the ignition system more effective so that the shell is not triggered by splinter hits of this. In this It has been proposed to increase the material thickness of the outer casing, which has meant that more powerful splinters have been needed in order to penetrate the casing. This reduces the capabilities of the opponent, who has to devote more resources and devices for achieving counter-attacking means which operate with larger splinters. However, the shell itself becomes heavier and has to be assigned a lower starting speed. In addition, the sensitivity upon striking targets is poorer. The ignition system itself is slower. Another way of solving these problems is to make the space between the shells larger. This necessitates greater dimensions of the approaching metal splinters which are supposed to cause short-circuiting before the target is struck. However, increased spacing between the casings means that the shell has to be made longer. In addition, there is an increase in the time between contact with the target and closing of the circuit via the twin casing, since the shell has to move until the casings have been deformed to create contact.

The ignition systems according to the above French and U.S. patents referred to in the introduction do not solve the above problems.

There is therefore a considerable need for an arrangement which is not sensitive to splinters of fairly small size, and in which, at the same time, the efficiency and the sensitivity can be maintained in the ammunition-bearing unit without the latter having to be redesigned, and the ignition system can operate with the desired sensitivity and with short triggering times, etc.

The main aim of the arrangement according to the present invention is to solve the above problems. The feature which can principally be regarded as characterizing the invention is, that one or more of the said casings is/are designed with sections which are electrically insulated from one another and which, when deformation of the shells occurs, are each able to establish an individual electrical contact (discernible by the detecting unit) with the opposite part or opposite parts of the other casing or casings (outside or inside the casing which bears the sections). A further characteristic feature is that the detecting unit distinguishes one or more electrical contact configurations effected by the sections and, as a function of this configuration or configurations, generates the initiation signal or the initiation signals.

In one embodiment, the casing which bears the sections has a plurality of sections, preferably between 3 and 20 sections. The detecting unit is in this case arranged to effect each initiation signal upon an electrical contact configuration which comprises contact established by two, three or more sections, lying or placed adjacent to one another, of the casing in question.

In one embodiment, the invention also provides directions on how the sections should be arranged on each sectioned casing. The latter can consist, for example, of glass-fiber reinforced plastic, on which contact material surfaces are applied.

In one embodiment, the detecting unit is also arranged so that it can effect the initiation signal or the initiation signals as a function of a sequence in which the different electrical contact configurations occur. Thus, a given configuration can cause an initiation signal only in a given sequence. If this sequence does not occur and/or is delayed, the detecting unit can generate the initiation signal or the initiation signals for another configuration, etc. The delay time for each initiation signal can be made dependent on the sequence for occurrence of the configurations and/or the points in time for onset of the configurations. different requirements can be made of the present arrangement in order to lessen the risk of splinter hits initiating the shell. The invention starts from the premise that the splinter hits will probably occur randomly over the nose of the shell. The lessening of the risk can be calculated. The probability of a splinter initiating the shell via a hit in a conventional twin casing may be considered to be 100%. The probability of a number of splinters, for example three splinters, hitting a sectioned twin casing in such a way that sections placed alongside one another are short-circuited is considerably less, and is estimated, in the case of three adjacent sections out of eight, to be about 10% of the probability of the shell being hit by three splinters. Here, no account has been taken of the possibility that one splinter would be able to short-circuit two sections. The latter risk is difficult to assess, but will probably be small, and lessens in inverse proportion to the caliber of the shell or missile if the distances between the sections are kept constant. The risk lessens even more in the case of larger warheads, where the probability falls still further and may become almost zero.

The invention is further advantageous when used in ignition systems with triple casings. The triple casing can differentiate between splinter hits and target strikes and is able to trigger the warhead of the shell even if one section has already been short-circuited. This means that the triggering of the warhead occurs more quickly than when there is a requirement for short-circuiting of several, for example three, sections, as is the case with a sectioned twin casing. The logics system of the shell can successively disconnect sections which have been penetrated and short-circuited by splinters. The requirement for triggering the warhead can thus be successively modified, as a result of which the function of the ignition system is impaired only by degrees, for example to the extent that in some cases, after the target has been struck, it takes a slightly longer time before the shell is triggered.

The ignition system with twin casing or triple casing can also be used in conjunction with another ignition system which detects shock waves in the casing of the ammunition-bearing unit. Such an ignition system is placed right at the back of the shell and is in this way well protected against firing, but is activated by shock waves which are generated by splinters hitting the shell. The invention thus makes it possible for the logics system in a shell with a sectioned twin casing, or triple casing, or sectioned triple casing, to function in such a way that in the event of damage to the more rapid and therefore more effective multiple casing system, a shock wave-detecting system will be connected in. This system is then not able to discriminate between splinters and strikes against targets, but it can be used as back-up when the ordinary ignition system has been rendered non-operational by firing, for example because far too many sections have been penetrated by splinters.

BRIEF DESCRIPTION OF THE DRAWINGS

A presently proposed embodiment of an arrangement which has the features characteristic of the invention will be described hereinbelow, with reference being made to the attached drawings in which.

DETAILED DESCRIPTION OF THE PREFERRED EMBODIMENT(s)

Figure 1:
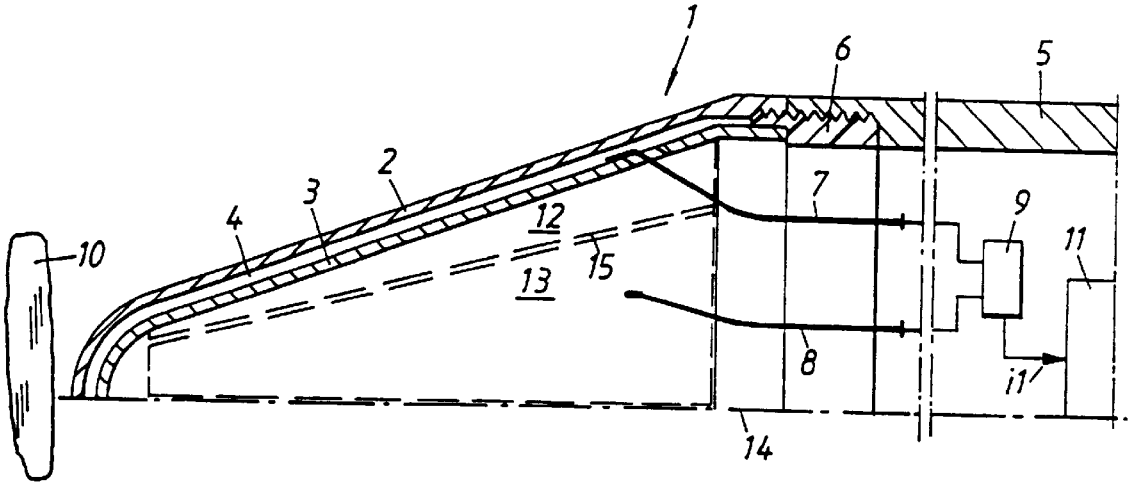
FIG. 1 shows, in longitudinal section, parts of a shell with a twin casing arrangement, wherein an inner casing is designed with electrical contact sections which are electrically insulated from one another.
Figure 1A:
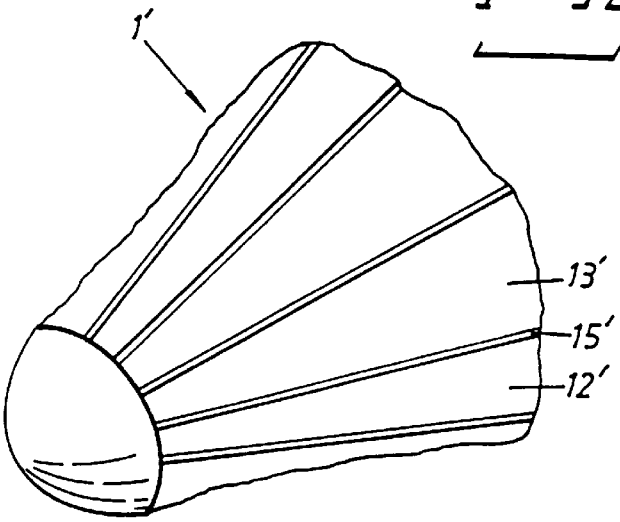
FIG. 1*a* shows, in an oblique perspective view from the front, parts of the sectioned inner casing.

In FIG. 1, reference number 1 designates the front parts of an ammunition-bearing unit (missile, shell, etc.). The unit I comprises an electrically conductive outer casing 2 and an electrically conductive inner casing 3. The casings are arranged with a space 4 lying between them. The casing 2 is connected to the frame 5 of the unit. The casings are electrically insulated from one another by a part 6 made of an insulting material. The casing 3 is electrically connected to conductors 7, 8 which are provided with insulation and arranged inside the unit 1. The conductors are connected to establish an electrical contact by means of a unit 9 which detects the casings 2 and 3 and which, when the unit 1 strikes against a target 10, will generate an electrical initiation signal (trigger signal) i1 to the symbolically represented charge 11 of the unit 1.

The casings 2, 3, the conductors 7, 8, and the detection unit 9 are known. According to the invention, however, the inner casing 3, in the example shown, is designed with sections 12, 13 which are electrically insulated from one another. The sections 12, 13 extend in the essentially longitudinal direction of the unit 1 (the longitudinal axis 14). In the embodiment of to FIG. 1, the sections are eight in number. The sections are separated by intermediate spaces 15. According to Figure la showing the unit 1', the sections 12', 13' can vary in number, as can the designs of the intermediate spaces 15'. By way of example, the invention functions with sections numbering between 2 and 20, preferably between 4 and 12.

The sections can have other paths and can, for example, extend in a spiral formation in the longitudinal direction, extend in the transverse direction, or extend in accordance with combinations of these two possibilities. In the illustrated embodiment, the sections are formed by means of contact material surfaces applied on a carrier, for example a carrier made of glass-fiber reinforced plastic. In this way, the inner casing can withstand high accelerations which may be of about 10000 g or so. The fastenings of the casings to the frame, the insulations, the wire-drawing, etc., can be designed in a known manner.

Upon impact against targets, the deformation or crushing of the nose of the ammunition-bearing unit leads gradually to more and more sections being short-circuited. By means of suitable design of the detecting unit 9, the shell's ignition system keeps a check on how many, and which, sections have been short-circuited. Different conditions can be imposed in this case for initiation of the warhead, for example that out of eight sections, three sections placed adjacent to each other need to have been short-circuited before initiation takes place. Such a requirement considerably lessens the risk of splinter hits initiating the shell, since the splinter hits may be assumed to occur randomly over the nose of the shell.

The inner casing and/or the outer casing can be divided into sections, i.e. divided up into parts which are insulated from one another. The electronics in the ammunition-bearing unit, i.e. the unit 9, impose the requirement that several, for example two or three, sections adjacent to one another will need to have made contact before the condition for ignition is satisfied. If the number of sections is fairly large, two sections lying next to one another will practically always be deformed on striking a target. In contrast, in the event of the unit 1 being fired at by splinters which randomly hit the nose of the shell, sections lying adjacent to one another are more seldom hit or deformed by a single splinter. In addition, hits by several, for example 2 to 3, splinters are required for initiation. By dividing the nose of the shell into eight sections, the probability of splinters hitting two adjacent sections is already down to 25% of the probability for random scattering, on the assumption that the shell is hit by two splinters. For 16 sections, the probability becomes 13%. The requirement for hits by two or more splinters also forces the opponent either to launch splinters with such great energy that they trigger the shell by virtue of their impact energy, or to launch more, but smaller, splinters in order to initiate the ignition system, or to wait until the warhead has come nearer before commencing the defence measures, which increases the risk of the target being hit.

Figure 2:
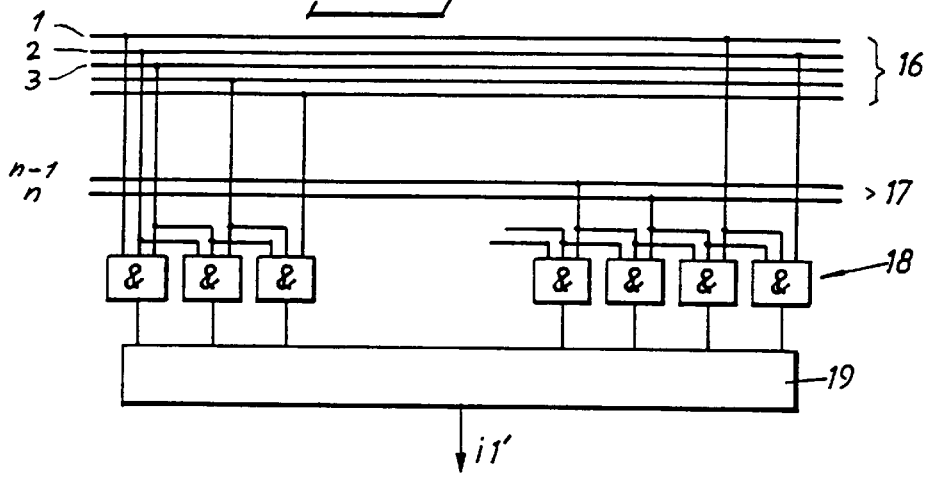
FIG. 2 shows, in circuit diagram form, logic circuits which form part of a detecting unit and which decode the sectioned twin casing.

Rapid triggering can also take place despite the use of a sectioned casing. If one assumes that the shell's impact against target occurs in the boundary line generatrix between two sections, both sections will give immediate contact and no extra delay occurs. It is reasonable to assume that the shell has to move 15 mm to be triggered in the worst case scenario, which occurs when the mid-line of a section coincides with that part of the shell generatrix which first makes contact with the target. This section thus has to be deformed until contact is made with the sections to each side, before the condition requiring contact between three adjacent sections is satisfied. Depending to some extent on the actual geometric shape of the nose of the shell, the shell will in this case need to move 15 mm before initiation takes place. This distance is based, for example, on using twin casings with 1 mm of air between the casings, the shell caliber being 120 mm, and the nose angle 2×20 degrees. This entails a time of 50 microseconds with a 300 m/s impact velocity. The mean delay for such a construction is approximately 25 microseconds. If the number of sections is increased, the delay can be reduced. The reduction is largely proportional to the number of sections. The unit 9 detecting when contact is established must be able, in accordance with the above, to distinguish between various contact configurations which are obtained when sections are used. The contacts established are decoded by the unit 9. FIG. 2 shows a first example of decoding which, upon contact being established between three adjacent sections, will bring about an outgoing initiation signal or trigger signal i1'. Sampling times of less than 1 microsecond are used in this decoding. The design according to FIG. 2 can be supplemented by known circuits which are needed in order to obtain the correct signal level, and drive circuits for driving a number of TTL circuits which correspond to the number of sections. Some circuits, not specifically shown here, may be needed in order to memorize that a section has been activated, i.e. has already been penetrated upon the target impact in question. Double decodings may be used, if appropriate, for creating redundancy and guaranteeing triggering. In the present embodiment, it is assumed that the number of sections n equals 8. A suitable condition for triggering the warhead is in this case that the number of adjacent, short-circuited sections (as logic ones to the electronics) will be three. FIG. 2 shows the wire connections to the various sections by reference numbers 16 and 17, which connections can be included in the same wire bunch or can be drawn individually. Reference number 18 indicates a number of 3-input AND-gates. Reference number 19 indicates an OR-gate. Alternatively, several levels of OR-gates can be used.

The sampling time in this case (two TTL levels)=2×10 ns=20 ns=>f=50 MHz.

With ring circuits, the circuit can consist of approximately 5–10 TTL levels, i.e. f=10–20 MHz. If a missile or equivalent is approaching the target at 200 m/s, this frequency means that a sampling (scanning of all sections) takes place for each 2 to 4 mm of travel.

Figure 3:
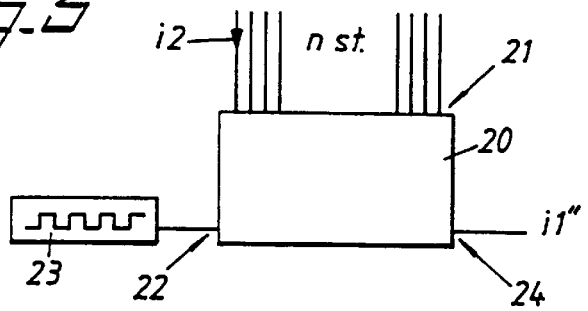
FIG. 3 shows, in circuit diagram form, a decoder which forms part of the detecting unit and which uses a memory function and signal formations as address signals in the memory function.
Figure 4:
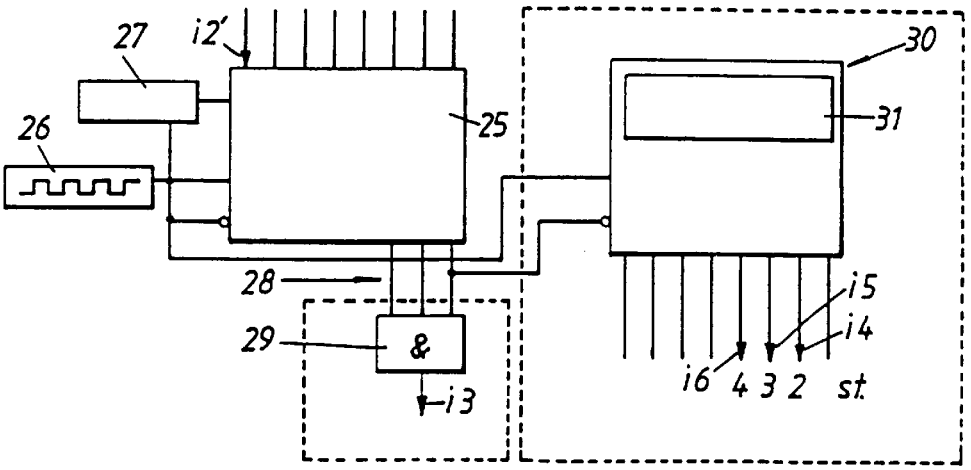
FIG. 4 shows, in circuit diagram form, the use of shift registers in the decoding function which forms part of the detecting unit.

In the embodiment according to FIG. 3, the current number of section signals is used as an address in a memory 20 which has address input 21 and connection 22 to a clock 23. An output signal i1" is obtained at an output 24. The current number of section signals i2 in this case forms an address. The address is used for looking up a certain row in a table. If the section signals together contain a triggering condition, for example give a byte with the appearance 0011 1000, the row contains a logic 1 which leads, via another circuit (not shown), to initiation i1" of the warhead of the shell or equivalent. The triggering condition is in this case that three section signals=address inputs adjacent to one another must have logic values 1. Another triggering byte is, for example, 1000 0011, which contains triggering conditions because the byte has to be seen as a circle in which the first and last bits also lie adjacent to one another. This is reflected in the mechanical construction of a twin casing divided into eight parts. A memory is preferably used which retains information without supply voltage. One example which may be mentioned is EPROM with burned-in coding. The last-mentioned memory has a read time of about 250 ns=>f=4 MHz. All the sections are therefore read off approximately at each millimeter of travel of the missile in the example above. The embodiment according to FIG. 3 can be used for flexible coding of triggering conditions. A number which is stored in the memory indicates how many section signals are active adjacent to one another. The output signal from one row in the memory table will then be able to be processed further. In this further processing, various conditions can be imposed on triggering, for example that two, three or more sections need to have been short-circuited for triggering of the warhead. The condition can be conceivably influenced by external measures, for example by adjusting a switch on the shell or the missile which incorporates the ignition system with electronics.

The embodiment according to FIG. 5 uses shift registers for counting the number of adjacent active sections. A shift register is denoted by 25. The register has an input for receiving signals i2' from the contact configurations at the sections. A clock 26 and a conductor 27 are connected to the register. The shift register reads how shifts are being made and writes in a known manner. An output from the shift register 25 is indicated by 28. In one embodiment, decoding of adjacent sections can be arranged with an AND-circuit 29 from which an initiation signal or trigger signal i3 is obtained. In this case it is assumed that the requirement for triggering (i.e. receiving the signal i3) is that three adjacent sections will give logic one. Decoding of three adjacent sections can be done with a three-input AND-circuit 29. The output of the AND-circuit is logic one when the shift register shifts the section signals in such a way that the three signals which give logic one come to lie on the inputs to the AND-circuit. The shift register 25 is coupled so that no bit is shifted out. Bit seven is shifted in to bit zero. A number of adjacent shift registers connected in series may be necessary here in order to detect a section signal. These are then coupled together in a known manner.

It is also possible to decode three adjacent sections with the aid of a counter 30 which comprises a shift register 31 which shifts in ones. The counter is connected to the output of the shift register 25 and the clock 26 and conductor 27. The shift register 31 is set to zero in the event of an inactive section signal (a zero) and shifts in logic ones for each active section signal. When a sufficient number of ones have been shifted in, a triggering condition is obtained. This solution remains flexible for the triggering condition which can also be set here via a switch (not specifically shown). Depending on the setting, triggering can take place upon activation of two adjacent sections with the signal i4, triggering can take place upon activation of three adjacent sections with the signal is, triggering can take place upon activation of four adjacent sections with the signal is, etc.

The invention is not limited to the embodiment which has been shown hereinabove by way of example, but can be modified within the scope of the following patent claims and the inventive concept.

I claim:

1. An ignition system for an ammunition-bearing unit comprising:

at least two casings including an outer casing and an inner casing, said outer casing at least partially surrounding said inner casing, said at least two casings being intended to undergo deformation upon striking a target to establish electrical contact, and a detecting unit for detecting when electrical contact is established and, upon actual striking of the target, emitting at least one initiation signal for triggering the charge of the ammunition-bearing unit, at least one of said casings including plurality of electrically insulated sections distributed around its periphery whereby upon deformation of the casings sections an individual electrical contact is established with the other casing, and wherein the detecting unit is adapted to distinguish one or more electrical contact configurations effected by the contact of at least two sections to generate the at least one initiation signal.

2. A system according to claim 1, wherein said inner casing has said sections which are electrically insulated from each other, and the detecting unit is arranged to effect at least one initiation signal in the event of an electrical contact configuration which comprises contact being established by means of at least two adjacent sections of said inner casing.

3. A system according to claim 1, wherein the sections of each sectioned casing consist of contact material surfaces which are electrically separated from each other and are applied on an underlayer of an insulating material.

4. A system according to claim 3, wherein said insulating material is glass fiber reinforced plastic.

5. A system according to claim 1, wherein the detecting unit effects the at least one initiation signal also as a function of a sequence in which the different contact configurations occur, a certain configuration causing an initiation signal only in a given sequence, and if this does not occur or is delayed, the detecting unit can generate the at least one signal for another configuration.

6. A system according to claim 1, wherein said detecting unit emits the at least one initiation signal after at least one delay time dependent on the sequence for occurrence of the configurations and/or times of the onset of the configurations.

7. A system according to claim 1, wherein the ignition system with the contact-establishing function of the at least one sectioned casting, interacts with a further ignition system which detects shock waves.

8. A system according to claim 1, wherein the detection unit comprises logics which detect the contact states for adjacent sections at short intervals.

9. A system according to claim 1, wherein the detecting unit operates with a memory function in which the detection signals from detected deformed sections at the time of each detection form an address for access to a table which specifies conditions for initiation of the at least one initiation signal.

10. A system according to claim 9, wherein at least one release signal from each current row in the table can be further processed with further conditions, including sequence conditions for contacts established between the sections, and/or setting of external contact mashers, before the at least one initiation signal issues from the detecting unit.

11. A system according to claim 1, wherein the sections of each sectioned casing extend substantially parallel in the longitudinal direction of the ammunition-bearing unit.

12. A system according to claim 8, wherein a detection frequency detected by said detection unit is in a range of about 10–20 MHZ.

* * * * *